US006060017A

United States Patent [19]

Yang et al.

[11] Patent Number: 6,060,017

[45] Date of Patent: May 9, 2000

[54] METHOD FOR SINTERING A METALLIC POWDER

[75] Inventors: Jin-Bin Yang, Kaohsiung; Weng-Sing Hwang, Tainan, both of Taiwan

[73] Assignee: Metal Industries Research & Development Centre, Kaohsiung, Taiwan

[21] Appl. No.: 09/227,256

[22] Filed: Jan. 8, 1999

[51] Int. Cl.[7] ..... B22F 3/12

[52] U.S. Cl. ..... 419/38

[58] Field of Search ..... 419/38, 39

[56] References Cited

U.S. PATENT DOCUMENTS 4,909,841 3/1990 Iyer et al. ..... 75/233

*Primary Examiner*—Ngoclan Mai

*Attorney, Agent, or Firm*—Watson Cole Grindle Watson, P.L.L.C.

[57] ABSTRACT

In a method for producing a sintered metallic product, a green compact of a powdery metallic alloy is enclosed and constrained in a rigid mold to suppress the swelling of the green compact during sintering.

4 Claims, 5 Drawing Sheets

METHOD FOR SINTERING A METALLIC POWDER

BACKGROUND OF THE INVENTION

1. Field of the Invention

This invention relates to a method for producing a sintered metallic product, more particularly to a method in which a green compact of a metallic powder is constrained by using a rigid mold during sintering. The density of a sintered billet is denser than that of a sintered billet free of using a rigid mold.

2. Description of the Related Art

Sintering is a process of bonding together distinct particles by the steps such as mixing powers, compacting and sintering. A green compact is formed for easy handling after compacting and is sintered at a temperature below the melting point of powder materials under normal pressure. Generally, the density of a sintered billet is increased as sintering time is increased. It is because the free energy should be decreased by the shrinkage of voids in the sintered billets to decrease the surface energy. However, the sintering behavior is changed, when two kinds of elemental powders, which have a large difference in diffusivity such as aluminum and titanium, are used as materials. A large amount of cavities are formed due to the Kirkendall effect. The Kirkendall effect is a phenomena occurred when two different kinds of elemental powder particles having large difference in diffusivity are interdiffused during sintering. The elemental powder particles having higher diffusivity will diffuse more into the other particles having lower diffusivity. Cavities or pores are formed in the region of particles having higher diffusivity. Finally, a loose, swelling and cracking sintered product is obtained.

Therefore, there is a need to avoid or suppress the formation of voids resulting from the Kirkendall effect when sintering a green compact of aluminum and titanium powders. An effective process, i.e. a hot isostatic pressing (HIP), has long been adapted for the sintering of aluminum and titanium powders. In this process, the so-called "canning " process is first carried out to load and seal the green compact of the metal powders into a flexible container. The loaded container is then pressed by applying uniformly a gas (or liquid) pressure to the container, and is sintered at an elevated temperature. This process can effectively suppress the generation of voids during sintering. However, the operation of this process is very complicated and the capital and operating costs are generally high.

SUMMARY OF THE INVENTION

Therefore, it is an object of the present invention to provide a method conducted under normal pressure for producing a sintered metallic product that is simpler and more cost effective than traditional HIP methods.

Accordingly, the method of the present invention comprises the steps of: forming a metallic powder into a green compact; enclosing and constraining the green compact within a rigid mold; and sintering the green compact at an elevated temperature under normal pressure.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
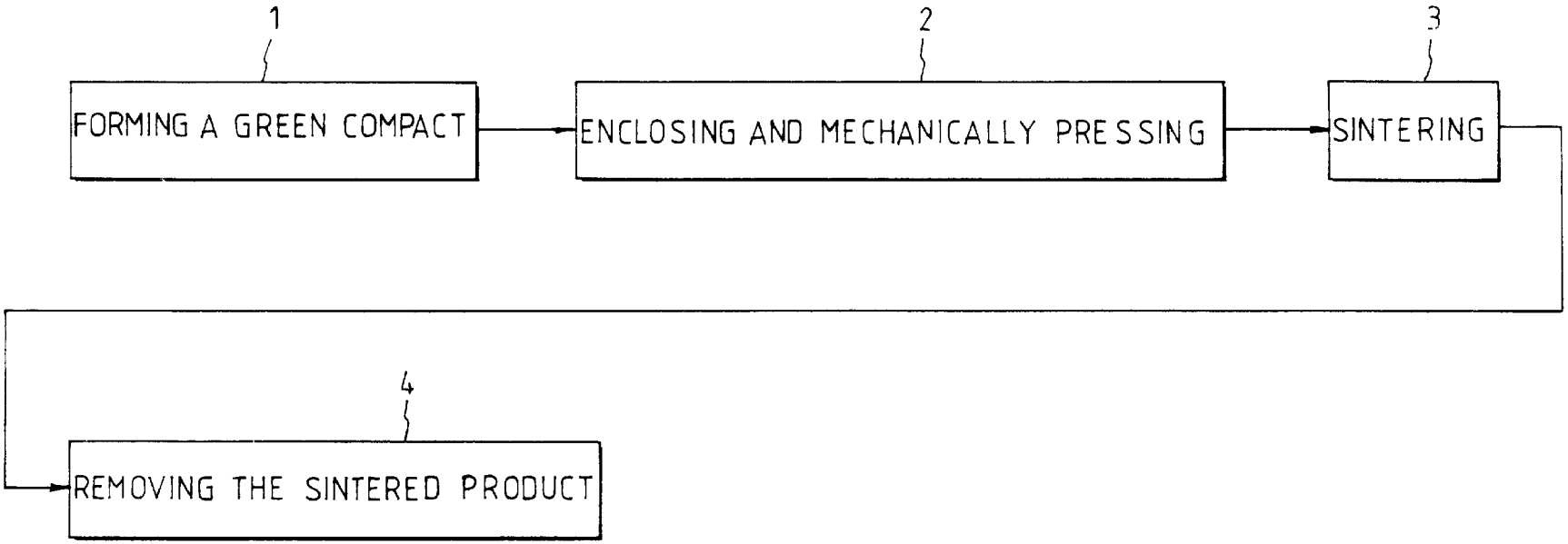
FIG. 1 is a flow diagram illustrating the method of the present invention.

As illustrated in FIG. 1, the preferred embodiment of the method of the present invention comprises the steps: (1) forming a green compact, (2) enclosing and constraining the green compact within a rigid mold, (3) sintering the enclosed green compact, and (4) removing the sintered product from the rigid mold.

Figure 2:
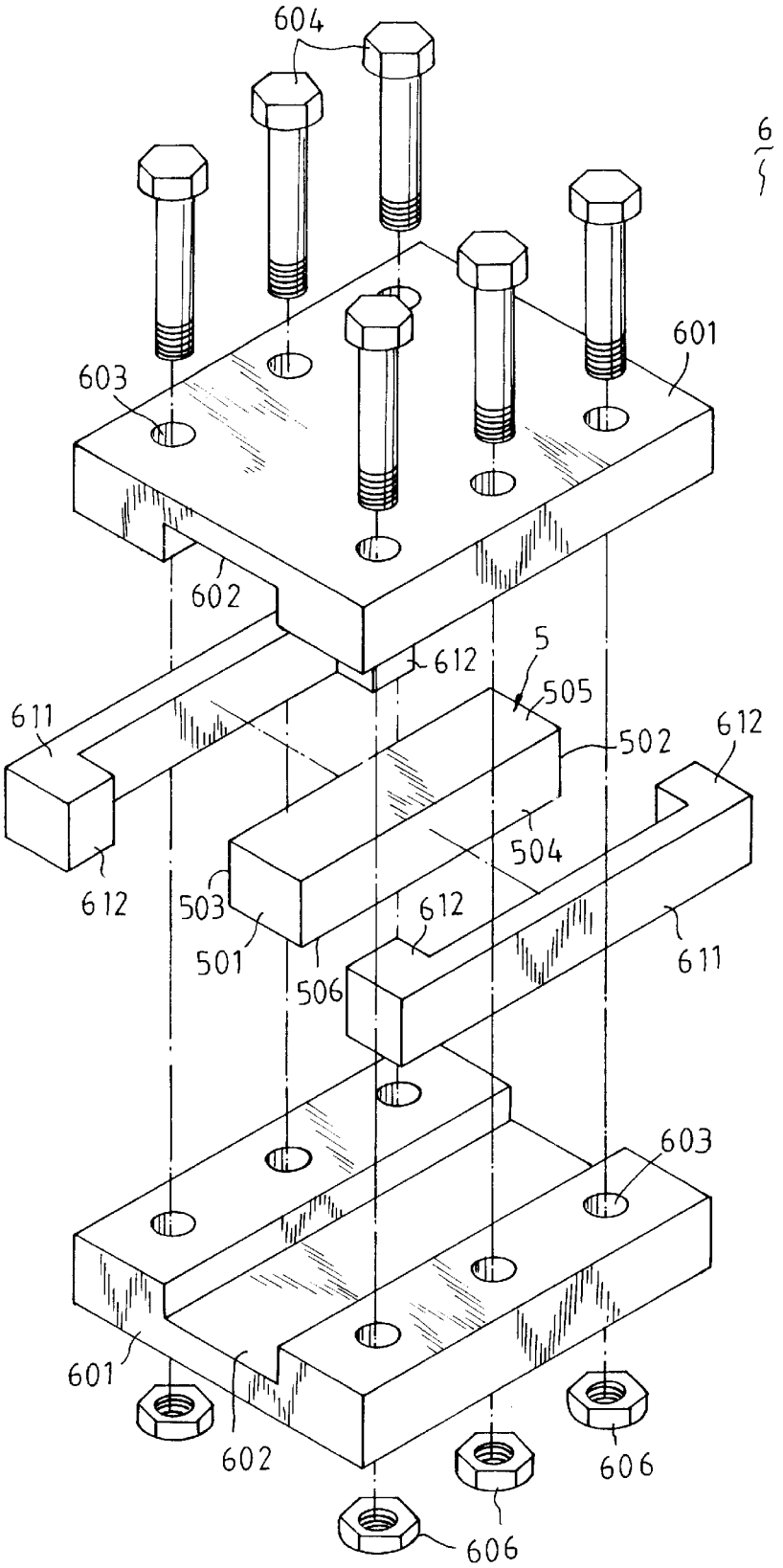
FIG. 2 is an exploded view of a rigid mold used in the method of the present invention together with a green compact that is to be sintered.
Figure 3:
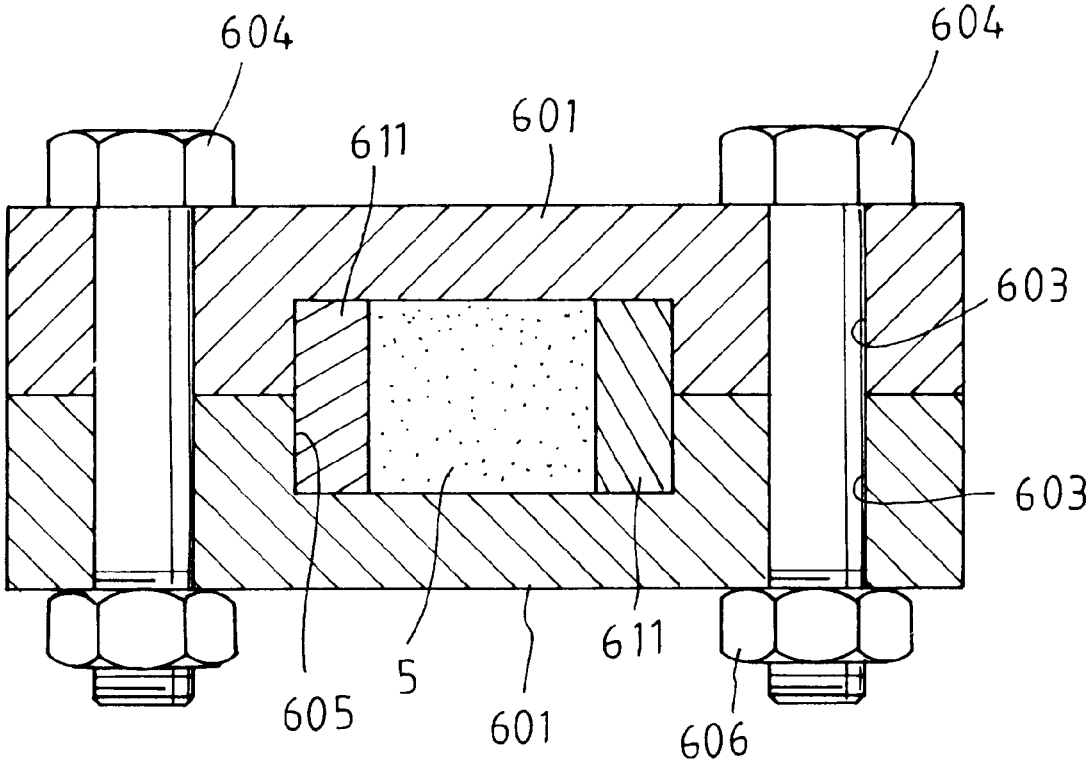
FIG. 3 is a cross-sectional view of the rigid mold of FIG. 2 in an assembled state.

Referring now to FIG. 2, a preferred embodiment of the rigid mold used in the present invention, designated by 6, is shown to comprise a pair of opposing first mold pieces 601, a pair of U-shaped opposing second mold pieces 611, and a plurality of bolts 604 and nuts 606. Each of the first mold pieces 601 has a recess 602 and a plurality of through holes 603 provided therein for passages of the bolts 604. Each of the second mold pieces 611 has two opposing end flanges 612. Referring to FIG. 3, the first and second mold pieces 601, 611 of FIG. 2 are assembled together, and the green compact 5 is enclosed and constrained therein. The second mold pieces 611 are separately disposed at the left and right sides of the green compact 5 to cover the left and right surfaces 503, 504 of the green compact 5. The corresponding opposing end flanges 612 of the second mold pieces 611 abut against each other at the front and rear surfaces 501, 502 of the green compact 5 and intimately contact the front and rear surfaces 501, 502 of the green compact 5. The first mold pieces 601 are disposed at the top and bottom sides of the partially covered green compact 5. The corresponding recesses 602 of the first mold pieces 601 complement to one another to form a cavity 605 to receive the green compact 5 and the second mold pieces 611. The second mold pieces 611 are held in tight contact with the green compact 5 as the cavity 605 receives fittingly the second mold pieces 611 and the green compact 5. Moreover, the top and bottom surfaces 505, 506 of the green compact 5 are placed in intimate contact with the first mold pieces 601. The green compact 5 is all enclosed and constrained by the rigid mold 6 as described above when the bolts 604 are inserted through the through holes 603 of the first mold pieces 601 and all locked by the nuts 606.

Figure 4:
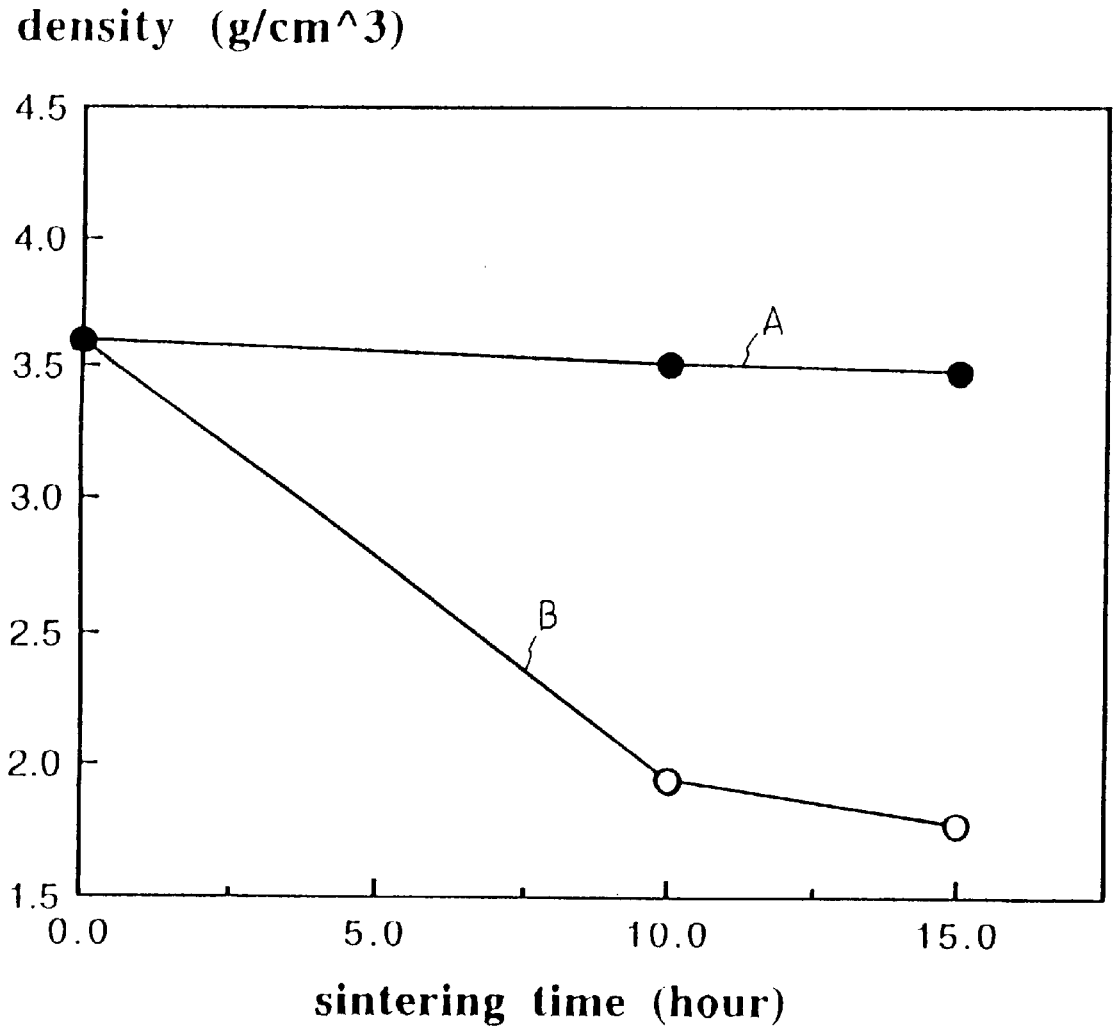
FIG. 4 shows plots of density change of sintered metallic powder vs. sintering time.

The benefits of sintering the green compact 5 using the rigid mold 6 according to the method of the present invention can be observed from FIG. 4. Curve A represents the variation of the density of the sintered green compact 5 of powdered Ti-Al alloy made by the method according to the present invention. Curve B represents the variation of the density of a sintered green compact 5 of powdered Ti-Al alloy made by sintering the green compact 5 without constraining the green compact 5 during the course of sintering. Both sintered green compacts 5 are sintered at a constant temperature of 645° C. and under normal pressure for 15 hours. Curve B exhibits a tremendous drop in the density of the green compact 5 during the course of sintering. The density of the green compact 5 is observed to have a 50% decrease after 15 hours of sintering. However, curve A shows a substantially constant density with only a slight decrease after 15 hours of sintering. These results demonstrate that the Kirkendall effect occurring during sintering can be greatly suppressed by the constrained mold in the method of the present invention. Since sintering is carried out under normal pressure, i.e., without using any pressurizing fluids, when compared to the conventional method, such as the HIP method which is employed under elevated pressure, the method of the present invention is simpler and more cost effective than the HIP method.

Figure 5:
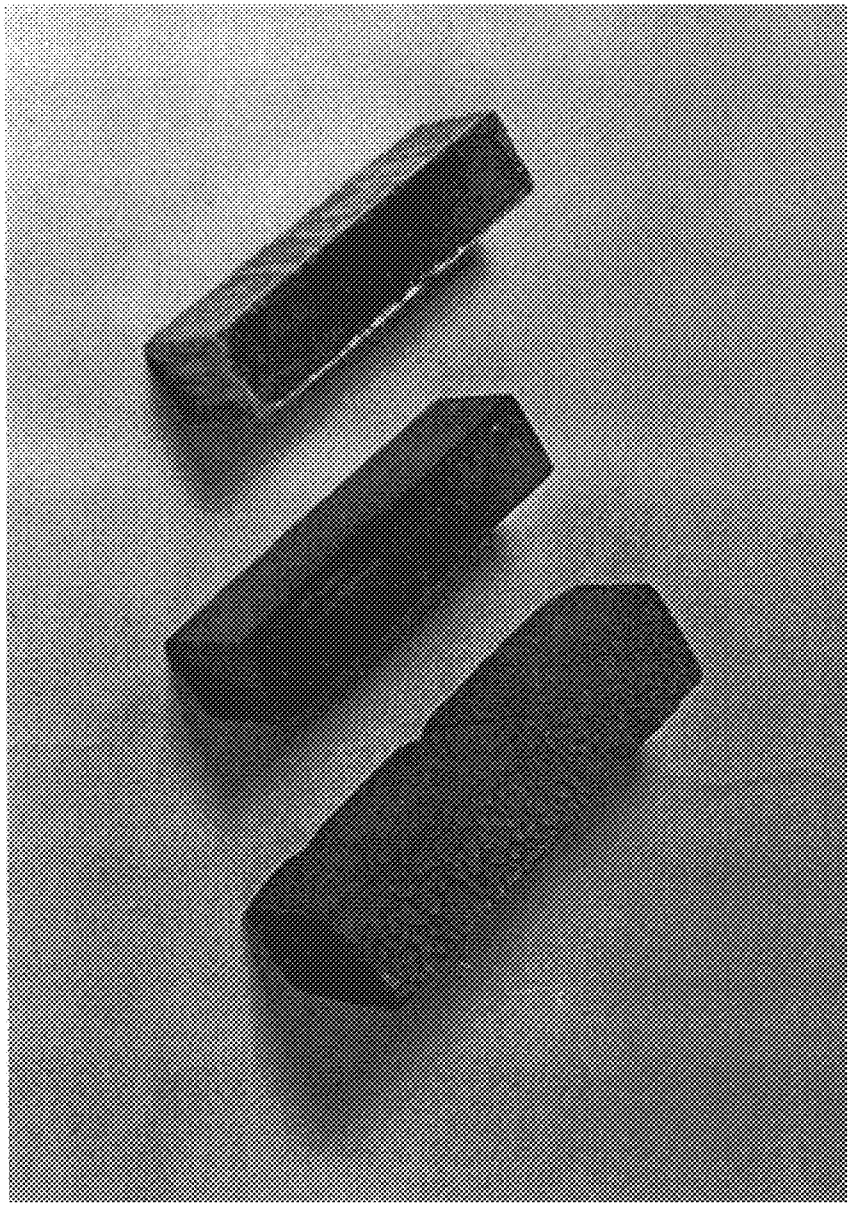
FIG. 5 shows a green compact, and a product produced according to the present invention and a comparative product produced conventionally.

FIG. 5 is a comparison of a green compact 5 (left) before sintering, a sintered product (center) produced by using the rigid mold according to the present invention, and a comparative sintered product (right) produced conventionally. As shown in FIG. 5, there is no distinct change in the appearance between the sintered product produced according to the present invention and the green compact 5 after sintering, however, a distinct change in appearance is detected between the sintered product produced conventionally and the green compact 5 after sintering. The sintered product produced conventionally exhibits a loose and fragile structure.

With the invention thus explained, it is apparent that various modifications and variations can be made without departing from the spirit of the present invention. It is therefore intended that the invention be limited only as recited in the appended claims.

We claim:

1. A method for producing a sintered metallic product, comprising the steps of:

forming a metallic powder containing elemental aluminum powder and titanium powder into a green compact;

enclosing and constraining said green compact within a rigid mold; and sintering said green compact at elevated temperature.

2. A method for producing a sintered metallic product, comprising the steps of:

forming a metallic powder into a green compact;

confronting opposing surfaces of said green compact with a plurality of separate mold pieces;

compressing said green compact by placing said mold pieces in intimate contact with said opposing surfaces of said green compact and fastening said mold pieces firmly together; and sintering said green compact at elevated temperature.

3. The method of claim 2, wherein said green compact has top, bottom, front, rear, left and right surfaces, said mold pieces comprising a pair of opposing first mold pieces and a pair of opposing U-shaped second mold pieces, said second mold pieces being disposed at the left and right sides of said green compact, each of said second mold pieces having two opposing end flanges to abut against said opposing end flanges of the other one of said second mold pieces, said end flanges covering and contacting said front and rear surfaces of said green compact, said first mold pieces receiving said second mold pieces and said green compact so as to cover and intimately contact the top and bottom surfaces of the green compact.

4. The method of claim 3, wherein said first mold pieces are provided respectively with recesses which complement one another to form a cavity to receive said first mold pieces and said green compact, said first mold pieces being fastened together by means of screws.

* * * * *